United States Patent [19]

Redding et al.

[11] Patent Number: 4,734,268

[45] Date of Patent: Mar. 29, 1988

[54] CLEAN AIR SYSTEM

[75] Inventors: Robert M. Redding, Brighton; Sava Stefanovic, Southfield; Badruddin K. Rangwala, Farmington Hills, all of Mich.

[73] Assignee: Elotrade AG, Switzerland

[21] Appl. No.: 851,174

[22] Filed: Apr. 14, 1986

[51] Int. Cl.[4] ..... A61L 2/18; A61L 2/20; A61L 2/24; B65B 55/18

[52] U.S. Cl. ..... 422/292; 422/28; 53/167

[58] Field of Search ..... 422/28, 292, 295; 53/167; 222/148; 62/78

[56] References Cited

U.S. PATENT DOCUMENTS

| | | | |
|---|---|---|---|
| 3,493,323 | 2/1970 | Demuth | 422/292 X |
| 3,650,678 | 3/1972 | Hansen | 422/292 |
| 3,893,832 | 7/1975 | Perry et al. | 53/167 X |
| 3,970,426 | 7/1976 | Stark et al. | 422/292 X |
| 4,055,035 | 10/1977 | Sjöstrand et al. | 53/167 |
| 4,056,921 | 11/1977 | Gilliand et al. | 53/167 |
| 4,547,339 | 10/1985 | McClure | 422/28 X |

*Primary Examiner*—David L. Lacey
*Assistant Examiner*—Jill Johnston
*Attorney, Agent, or Firm*—John P. Moran

[57] ABSTRACT

A clean air system which alternately provides a sterilant for sterilizing cartons in one chamber and a sterilant/air mixture for sterilizing machine components in three chambers. This is accomplished with the same system by simply resetting a three way valve, one control for a plurality of dampers, and the speeds of an inlet fan and a discharge fan.

8 Claims, 2 Drawing Figures

| DAMPERS | DUCTS | C.F.M. CARTON STERIL. | C.F.M MACHINE STERIL. |
|---|---|---|---|
| 24 | 21 | 3520 | 500 |
| 104 | 98 | 1780 | 320 |
| 40 | 38 | 2050 | 300 |
| 20 | 18 | 1470 | 200 |
| 128 | 126 | 900 | 0 |
| 130 | 129 | 900 | 0 |
| 78 | 76 | 170 | 0 |
| 68,70,72 | 82,86 | 30 | 0 |
| 94 | 48,56,60 | 90 | 0 |
| | 90,91,92 | 120 | 60 |
| | 108,109 | 160 | 80 |
| | 112 | 400 | 200 |
| 54 | 52 | 0 | 1160 |
| 137 | 138 | 200 | 0 |

CLEAN AIR SYSTEM

TECHNICAL FIELD

This invention relates generally to a package or carton forming, sterilizing, filling and sealing machine and, more particularly, to a clean air system therefor.

BACKGROUND ART

Heretofore, forming, filling and sealing machine sterilization and carton sterilization have either been completely separate operations, each with its own sterilization apparatus, or the sterilization process directed toward the cartons has been considered sufficient to simultaneously sterilize the associated machine components. While such arrangements have been generally satisfactory, it is desirable to have a simplified method of utilizing the same equipment for the two sterilization processes, with each satisfying its own special criteria.

DISCLOSURE OF THE INVENTION

A general object of the invention is to provide an improved method of utilizing the same equipment to alternate from a sterilizing atmosphere suitable for sterilizing cartons to a sterilizing atmosphere suitable for sterilizing all machine surfaces, ducts and filters, and the apparatus for accomplishing same.

Another object of the invention is to provide a system for alternately providing sterilant (1) to a carton sterilizing chamber for sterilizing cartons, and (2) through a filling and sealing chamber and the carton sterilizing chamber to a turret chamber for machine sterilization.

A further object of the invention is to provide a combined machine sterilization and normal carton production sterilization system, with means for alternating the required respective flow rates and pressures throughout the system.

Still another object of the invention is to provide a clean air system wherein sterilant is provided to a carton sterilizing chamber in a liquid or particulate form and, alternately, to all machine chambers in a vapor or molecular form.

A still further object of the invention is to provide a clean air system wherein filtered air is supplied at a high flow rate during normal machine operation, and at a lower flow rate during sterilization of the machine components and filters, the change-over being accomplished with the same system by simply resetting a three way valve, moving one control mechanism to change the setting of a plurality of dampers, and changing the speeds of an inlet fan and a discharge fan.

These and other objects and advantages will be more apparent when reference is made to the following drawings and the accompanying description.

BEST MODE OF CARRYING OUT THE INVENTION

Figures 1, 2:
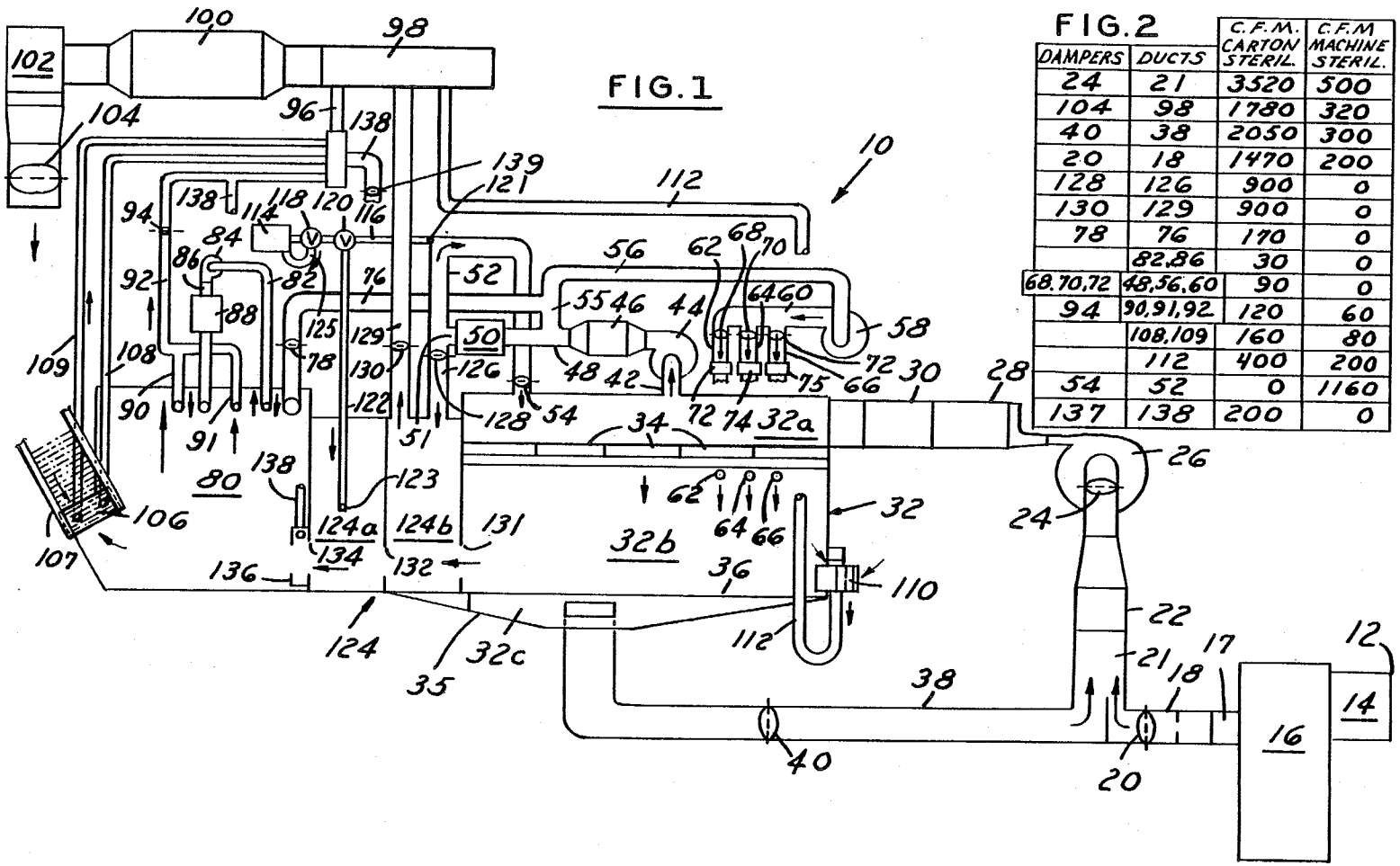
FIG. 1 is a schematic drawing of machine components embodying the inventive clean and sterile air system.
FIG. 2 is a chart showing preferred air flows for respective carton and machine sterilization operations at various points throughout the system.

Referring now to the drawings in greater detail, FIG. 1 illustrates an overall clean air control system 10 including the following components in a series arrangement: an inlet 12, a rough filter housing 14, an air dryer 16, a mist eliminator 17, a duct 18 having a damper 20 mounted therein, a duct 21 having a fine filter 22 (95% efficient for particles larger than 0.3 micron) and a damper 24 mounted therein, an inlet fan 26, a duct 28 having a high efficiency filter 30 (99.97% efficient for particles larger than 0.3 micron) included therein, a fill and seal chamber 32 having an ultra high efficiency filter 34 having an efficiency rating higher than 99.97%, and mounted therein, dividing the chamber 32 into chambers **32*a*, 32*b* and 32*c*, with a pan 35 at the bottom thereof. A perforated drain cover 36 separates the chambers 32*b* and 32*c*, and a recirculation duct 38 having a damper 40 mounted therein communicates between the drain chamber 32*c* and the duct 22. The chamber 32*b*** serves as a filling and top forming and sealing chamber, as will be explained.

Air from the chamber **32*a* is communicated via a duct 42 to a fan 44, an ultra high efficiency filter 46, a duct 48, a heater 50, a duct 51, and a connecting duct 52 including a damper 54 back into the chamber 32*a*. A duct 55 communicates from the duct 48 to a duct 56 and a blower 58 and thence through a duct 60 having triple by-pass ducts 62, 64 and 66 to the chamber 32*b*. The ducts 62,64 and 66 have respective fixed dampers 68,69 and 70 and heaters 72,74 and 75 mounted therein. The filter 46, like the filter 34**, has an efficiency of 99.995 percent for particles larger than 0.12 micron.

Air is also communicated from the duct 56 via a duct 76 including a damper 78 into the carton end sealing turret chamber 80, wherein blanks are opened into tubular form and loaded onto mandrels of a turret (not shown) for effectuating the closing of one end thereof. Air leaves the chamber 80 via a duct 82 to go through a blower 84 and a further duct 86 including a gas heater 88, and back into the chamber 80. Air also leaves the chamber 80 via parallel ducts 90 and 91 into the duct 92. A fixed damper 94 is mounted in the duct 92. The latter communicates with a duct 96 leading into an exhaust duct 98 including a scrubber 100. Attached to the discharge 104 mounted at the outlet thereof.

An isolation box (isobox) 106 is integral with a magazine 107 with a controlled clearance around stacked carton blanks at the inlet to the turret chamber 80, with a pair of ducts 108 and 109 leading therefrom to the duct 96. A second isobox 110 is mounted at the outlet from the fill and top seal chamber **32*b*, with a duct 112 leading therefrom to the exhaust duct 98. The isoboxes 106 and 110 serve to create a velocity from the internal forced air systems in chambers 80 and 32*b* respectively, to produce a pressure drop, with suction means to remove the air to the scrubber 100 via the ducts 108/109 and 112**, respectively.

Sterilant from a hydrogen peroxide generator 114 is communicated via a feed line 116 including a by-pass valve 118, a diverter valve 120 and a nozzle 121 to the duct 52 for mixing with the air therein. A feed line 122 having a nozzle 123 at the end thereof extends from the three-way valve 120 into the "wet" or sterilizing side **124*a* of a sterilization chamber 124. When sterilant is not needed, the valve 118 serves to cause the sterilant to return via a line 125 to the generator 114. A duct 126 including a damper 128 communicates from the duct 51 into the "dry" or drying side 124*b* of the chamber 124. A duct 129 including a damper 130 leads from the dry chamber 124*b* to the exhaust duct 98**.

A carton outlet opening 131 is formed between the front or near end of the dry chamber **124*b* and the filling and end sealing chamber 32*b*. A passage 132 is formed at the back or far end of the chamber 124 between the dry and wet sections thereof. A carton inlet opening 134 is formed between the near end of the wet chamber 124*a* and the turret chamber 80. A suction box 136 is mounted in the opening 134, with a duct 138 including a damper 139 leading therefrom to the duct 96**.

OPERATION

It should be noted that the carton travel through the forming, sterilizing, filling and sealing machine including the air and sterilant control system 10 is from left to right in FIG. 1, i.e., as flat blanks leave a the magazine and the associated isobox 106 into the turret chamber 80, they are opened into rectangular or square tubes and loaded onto the mandrels of the turret (not shown) for the end closing and sealing operation. The cartons thereupon enter the wet side **124*a* of the sterilization chamber 124 through the opening 134, wherein they are subjected to a sterilant in a particulate form at a predetermined temperature, while they travel the length of the chamber, continue sterilization across the crossover passage 132 and into the dry side 124*b* wherein they are heated and dried while traveling in the opposite direction to the opening 131 where they enter the chamber 32*b* to be filled and end formed and sealed, prior to discharge through the isobox 110**.

In contrast to the direction of travel of the cartons, the air involved is caused to generally flow through the system 10 from right to left in FIG. 1, whether machine sterilization or carton sterilization is in effect. Referring now to FIG. 2, it is noted that typical air flows in cubic feet per minute (CFM) are listed, along with the respective ducts and associated dampers through which such flows are effective for each of the normal carton sterilization and the machine sterilization operations. When switching from one operation to the other, the dampers 20,24,40,54,78,104,128 and 130 are each reset simultaneously by suitable external control means (not shown), in addition to resetting the inlet fan 26 and the discharge fan 102, i.e., at half speed for the machine sterilization flow and full speed for the carton sterilization. Such resetting of the dampers and change in fan speeds serve to change the air flow in the ducts 18,22,38,51,52,55,56,76,82,86,90,91,92,96, 98,108,109,112,126,129 and 130 as shown in FIG. 2.

With the respective fans, dampers and ducts set for machine sterilization operation, it is important to note that all the machine surfaces, all duct surfaces, and all filters will become sterilized by virtue of a hydrogen peroxide sterilant being sprayed through the feed line 116 and thence into the supply duct 52 to combine with hot air from the heater 50, and thence past the damper 54 to the chamber **32*a* as a vapor. For this operation, the three-way diverter valve 120 is set to prevent the sterilant from entering the feed line 122 leading into the wet carton sterilizing chamber 124*a*. The vaporized hydrogen peroxide passes through the filters 34 into the chamber 32*b* and partially condenses on the colder machine and duct surfaces. The continued flow of the hot air from the heater 50 serves to activate the hydrogen peroxide, establishing an acceptable kill rate for commercial sterility. The heater is left on until the wetted surfaces have dried. In the interim, the remaining vapor and hot air mixture passes through the drain cover 36 to the drain pan 35, from which the mixture is directed into the duct 38 and drawn into the duct 21 to mix with the air from duct 18 by the inlet fan 26. The mixture is thereupon directed via the duct 30, the chamber 32*a*, and the filter 34 to the filling and sealing chamber 32*b*. The sterilant/air combination also flows through the opening 131 into the dry chamber 124*b*, through the passage 132 into the wet chamber 124*a* and, thence, through the opening 134 into the turret chamber 80 to sterilize those chambers and the various ducts 126,130,76, 82,91,92,91,90,108 and 109** associated therewith.

The peroxide/air mixtures attempting to leave the respective chamber 80 and **32*b* via the inlet isobox 106 and the outlet isobox 110, respectively, are met by incoming air and diverted through respective ducts 108/109 and 112 to the exhaust duct 98**, rather than being permitted to discharge to the local atmosphere.

INDUSTRIAL APPLICABILITY

It should be apparent that the invention provides an improved means for alternately providing a sterilant for sterilizing cartons in one chamber and a sterilant/air mixture for sterilizing machine components in three chambers with the same system by simply resetting a three way valve, one control for a plurality of dampers and the speeds of an inlet fan and a discharge fan.

While but one embodiment of the invention has been shown and described, other modifications thereof are possible within the scope of the following claims.

The embodiments of the invention in which an exclusive property or privilege is claimed are defined as follows:

1. A clean air system comprising:

a turret chamber, a carton sterilizing chamber, and a filling chamber, each of said chambers having machine components;

sterilant generator means for generating a sterilant in particulate form, a source of air under pressure, a plurality of air ducts communicating with each other, said source of air under pressure, and each of said chambers, means for selectively alternately supplying sterilant in a particulate form to selected ones of said air ducts and to said carton sterilizing chamber, heater means in one of said air ducts for heating said air to mix with said particulate sterilant to provide sterilant in a vapor form, a plurality of dampers mounted in selected ones of said ducts, and means for simultaneously resetting said dampers for varying air flows in respective ones of said ducts for mixing said sterilant with air for sterilizing the machine components in all of said chambers in said vapor form.

2. A clean air system comprising:

a turret chamber, a filling chamber, an intermediate carton sterilizing chamber, each of said chambers having machine components, sterilant generator means for generating a sterilant in particulate form, means for directing air from a source of air under pressure at a first predetermined volumetric flow rate into said chambers, means for providing and directing sterilant in a particulate form into said sterilizing chamber for sterilizing cartons, means for combining said sterilant with heated air to provide a sterilant vapor form, and means for directing said sterilant vapor at a second predetermined volumetric flow rate less than said first predetermined volumetric flow rate into said chambers for sterilization of the machine components in said chambers by condensing said sterilant vapor on said machine components prior to a carton processing operation.

3. A clean air system comprising:

a turret chamber, a filling chamber, an intermediate carton sterilizing chamber, sterilant generator means for supplying a sterilant in particulate form, an inlet fan, a source of air in flow communication with said inlet fan, a discharge fan, a plurality of operatively interconnected ducts communicating with said chambers and between said inlet fan and said discharge fan, means for heating said air and mixing the heated air with said sterilant to provide sterilant in a vapor form, a three-way valve positioned and arranged with respect to said ducts for selectively alternately directing said sterilant in particulate form into said sterilizing chamber and in a vapor form into one of said interconnected ducts, a plurality of adjustable dampers in selected ones of said ducts, and means defining openings between said sterilizing chamber and each of said turret and filling chambers for allowing cartons to pass through said chambers.

4. The clean air system described in claim 3, further comprising an ultra high efficiency filter in said filling chamber having an efficiency rating higher than 99.97%.

5. The clean air system described in claim 3, wherein one of said ducts is connected to said filling chamber and said inlet fan such as to recirculate air flow from said filling chamber back through said inlet fan to mix with air in said inlet fan.

6. The clean air system described in claim 5, wherein said adjustable dampers are located in said recirculating duct, in an inlet duct connected to said inlet fan, in ducts connected to each of said chambers, in a discharge duct connected to said discharge fan, and in a discharge duct connected to said carton sterilizing chamber.

7. A clean air system comprising:

a carton and sealing turret chamber, a filling and carton top forming and sealing chamber, an intermediate carton sterilizing chamber, each of said chambers having machine components, means for directing air from a source of air under pressure at a predetermined volumetric flow rate into each of said chambers, first nozzle means for directing a sterilant in particulate form into said sterilizing chamber for sterilizing cartons, a heater operatively connected to and outside said chambers for receiving and heating air, and second nozzle means for mixing particulate sterilant with heated air to produce sterilant in a vapor form and directing the sterilant vapor into said chambers for sterilizing by condensing the sterilant on the machine components prior to a carton sterilizing operation.

8. The clean air system described in claim 7, wherein the air from said source of air under pressure and said sterilant vapor respectively flow through said chambers in the opposite direction to the travel of cartons therethrough.

* * * * *